US005448256A

United States Patent [19]

Ohashi et al.

[11] Patent Number: 5,448,256

[45] Date of Patent: Sep. 5, 1995

[54] ANTENNA

[75] Inventors: Susumu Ohashi, Coppell; Jon Y. Suehiro, Dallas, both of Tex.

[73] Assignee: Uniden America Corporation, Fort Worth, Tex.

[21] Appl. No.: 276,215

[22] Filed: Jul. 15, 1994

[51] Int. Cl.[6] ..... H01Q 1/14

[52] U.S. Cl. ..... 343/878; 343/905

[58] Field of Search ..... 343/713, 873, 878, 900, 343/905, 906; H01Q 1/32, 1/14

[56] References Cited

U.S. PATENT DOCUMENTS

| | | | |
|---|---|---|---|
| 2,181,327 | 11/1939 | Guggenheim | 343/878 |
| 3,646,561 | 2/1972 | Clarke | 343/873 |
| 3,789,418 | 1/1974 | Reiber et al. | 343/900 |
| 5,198,829 | 3/1993 | Marshal | 343/878 |

FOREIGN PATENT DOCUMENTS

| | | | |
|---|---|---|---|
| 1127674 | 12/1956 | France | 343/713 |
| 2126873 | 11/1972 | Germany | 343/713 |
| 52-23242 | 2/1977 | Japan | 343/878 |
| 1333382 | 10/1973 | United Kingdom | 343/713 |

OTHER PUBLICATIONS

Grove Enterprises, Inc., May–Jul. 1992 Catalog p. 23 "Hidden Antenna".

Tessco Technologies, Inc., Buyer's Guide Mar. 1994–Aug. 1994 pp. 666–667 "Cellular Antennas".

*Primary Examiner*—Michael C. Wimer

*Attorney, Agent, or Firm*—Daniel R. Brown

[57] ABSTRACT

A low cost antenna assembly is disclosed which is formed from a flexible wire and a pair of suction cups for supporting the wire in a substantially linear fashion. A feed line couples the wire antenna to a receiver. Further, a method for fabricating the antenna is disclosed.

9 Claims, 1 Drawing Sheet

FIG. 1
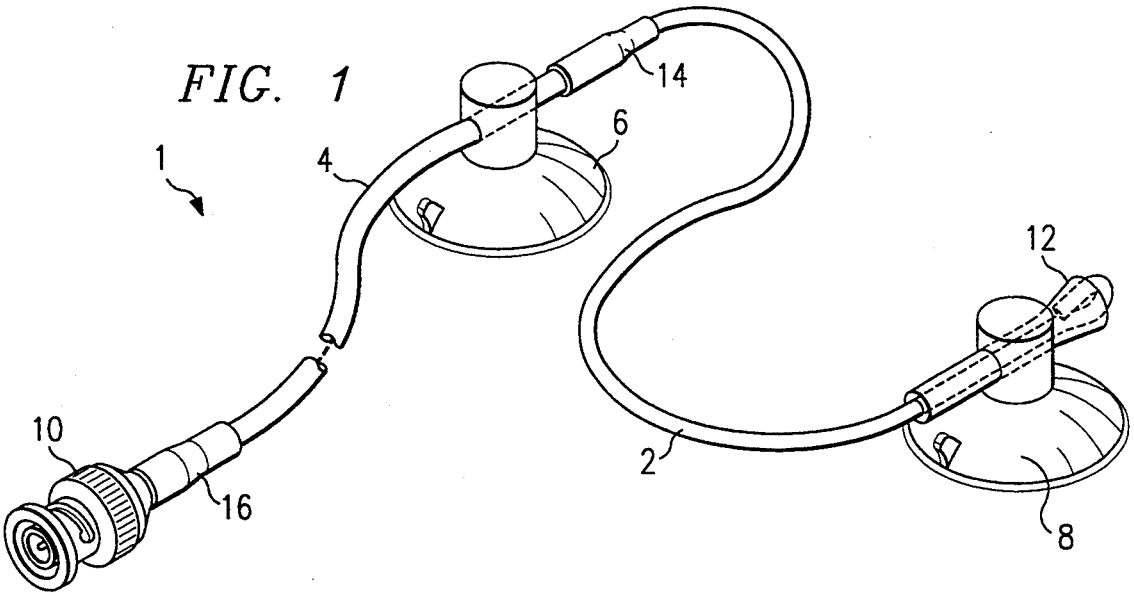
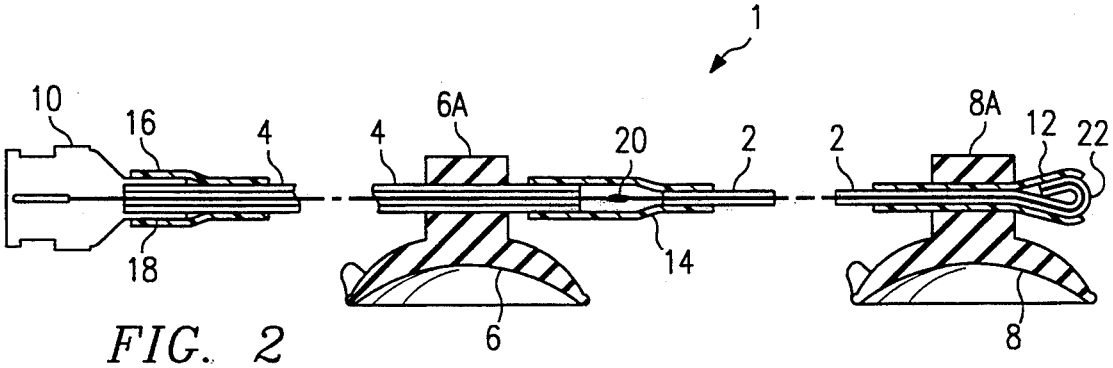
FIG. 2
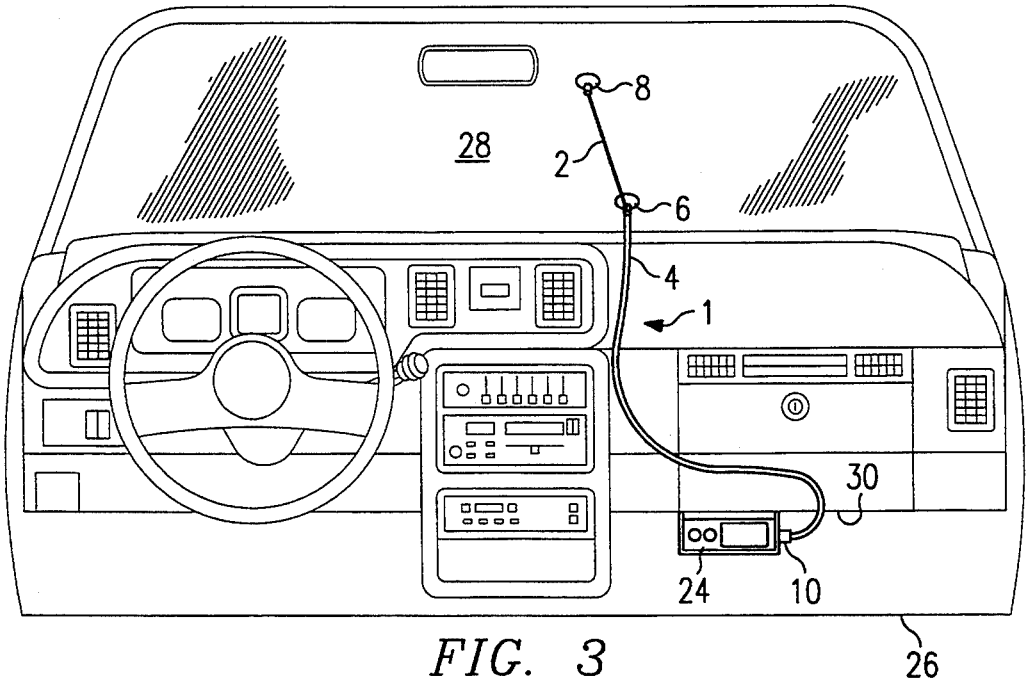
FIG. 3

ANTENNA

TECHNICAL FIELD OF THE INVENTION

This invention relates to antennas. In one embodiment, a low-cost scanning receiver antenna is disclosed.

BACKGROUND OF THE INVENTION

Antenna design is a mature technology and many types of antenna structures have been conceived of, constructed, and tested. Antenna propagation characteristics can vary between narrow and broad frequency bands, and between omnidirectional coverage and high-gain, narrow beam width designs.

One antenna type that is popularly utilized is the broad band scanning receiver antenna. A broad band antenna design is well suited for receivers which receive a broad range of frequency. Since scanning receivers are frequently used to receive local broadcasts having relatively strong signals, such as local police transmissions, high gain characteristics are not essential.

Scanning receivers are available in hand-portable, mobile and base configurations. For each of these configurations there is an antenna design which is best suited for the particular application. Direct mounted antennas are well suited for hand-portable scanners. For base scanners, either direct mounted or remotely mounted antennas employing coaxial feed lines to facilitate remote, or elevated, antenna mounting are suitable. Mobile scanning receivers, or any mobile receiver for that matter, are best utilized if a remotely mounted antenna having a feed line is employed. This allows the antenna to be positioned so that radio waves will not be shielded by the metallic structure of the mobile vehicle.

In the case of direct mounted antenna, it is fairly straightforward to design an antenna with good performance characteristics and at low cost. It is commonly known that low cost, collapsible section, antennas have been employed for base scanning radios and other receiver applications.

When marketing a scanning receiver, it is useful to provide an antenna with the receiver so that the receiver can be used immediately upon receipt. Otherwise, a user would have to obtain an antenna from a third party before operating the receiver to receive radio signals. Of course, a user can adapt the receiver to utilize an alternate antenna type, if so desired.

If an antenna is not provided with a mobile scanning receiver, then the user must obtain an antenna and install it into the vehicle in which the receiver is to be used. A professionally installed mobile antenna can be quite expensive. Especially if the combined cost of the antenna and installation are contrasted with the relatively low cost of mass-produced mobile scanning receivers. It is not uncommon for the cost of the installed antenna to exceed the cost of the mobile scanning receiver.

There is a need for a low cost antenna suitable for installation in a vehicle, for receiving radio signals and feeding the signals to a receiver, via a feed line. Further, there is a need for such an antenna which can be easily installed by the end user such that professional installation assistance is not needed.

SUMMARY OF THE INVENTION

A low cost antenna is disclosed together with a method for making the same. The antenna is suitable for use with vehicular mounted scanning receivers. However, the antenna is also suitable for use with other receiver types used in fixed and mobile environments.

The antenna in the preferred embodiment includes a flexible wire antenna with a suction cup at each end and a feed line connected to one end of the wire antenna for coupling the received signal from the wire antenna to a receiver. In this configuration, the antenna is of low cost and provides for simple installation by an unskilled end user.

A common coaxial cable can be used for the feed line and a simple insulated wire can be used for the antenna wire. By utilizing heat-shrinkable tubing to position the suction cups and adjust the diameter of the antenna wire, the antenna can be fabricated using a pair of identical suction cups, further reducing the cost. A suitable radio frequency connector is attached to the free end of the feed line to facilitate connection to a receiver.

In another embodiment, the antenna wire is formed by removing the outer insulation jacket and outer conductor from a coaxial feed line, thereby exposing the inner insulation and center conductor, which act as the antenna wire.

The antenna is assembled by passing the feed line and antenna wires through holes formed in mounting bosses on the suction cups. A press fit is used to hold the suction cups in place, and, positioning of the suction cups is further augmented by placement of the heat-shrinkable tubing.

The entire assembly can be fabricated using only a length of coaxial cable, two suction cups, a length of heat-shrinkable tubing, and an optional radio frequency connector. It is easily installed in a motor vehicle, or other location, by pressing the suction cups onto a smooth surface such that the antenna wire is held in a substantial linear fashion. Further, the installation can be accomplished by an end user who is unskilled in antenna installation.

BRIEF DESCRIPTION OF THE DRAWINGS

The features of the present invention which are believed to be novel are set forth with particularity in the appended claims. The invention, together with further objects and advantages thereof, may be best understood by making reference to the following description taken in conjunction with the accompanying drawings, in the several figures of which like reference numerals identify identical elements, and wherein:

FIG. 1 is a view of the antenna assembly in the preferred embodiment of the present invention.

FIG. 2 is a cross sectional view of the antenna assembly in the preferred embodiment, showing assembly details.

FIG. 3 is a view of a typical installation of the antenna assembly.

DETAILED DESCRIPTION

Reference is directed to FIG. 1, which a a view of the antenna assembly 1 in the preferred embodiment. The antenna assembly 1 includes a signal receiving element 2, (also known as an antenna wire), which is formed from a flexible conductive wire which may or may not have an insulating jacket. The insulating jacket is preferred because it protects and strengthens the antenna wire 2 and also adds an improved esthetic quality to the product. It is important that the signal receiving element 2 be flexible to facilitate mounting the antenna assembly 1 on an irregular surface, such as an automobile windshield.

The antenna wire 2 is electrically coupled to a center conductor in a coaxial cable 4. The coaxial cable serves to conduct and couple the signals received by the antenna wire to a receiver, (not shown). The coaxial cable 4 may be a standard commercial type having a center conductor, an inner insulation layer, an outer conductor, and an outer insulation jacket. Whatever specific type of coaxial cable is used, it is desirable that the cable be of low cost and flexible. Further, it is desirable that the coaxial cable 4 have a small outside diameter so that the overall size of the antenna assembly 1 is minimized and so that installation of the antenna assembly 1 is made as simple and convenient as possible.

Installation of the antenna assembly 1 is facilitated using a pair of suction cups 6 and 8 which are disposed along the antenna assembly 1. Each suction cup has a molded mounting boss with a hole formed through it. A first suction cup 6 is located near the connection of the antenna wire 2 and the coaxial cable 4, and, a second suction cup 8 is located at the opposite end of the antenna wire 2 from the first suction cup. The suction cups are located at opposite ends of the antenna wire 2 so that the antenna wire can be held in an extended position when installed, and thereby receive the greatest signal level possible. The combination of a flexible antenna wire 2 and the pair of suction cups 6 and 8 provide for extremely simple installation in virtually any type of vehicle which has smooth non-metallic surfaces such as glass or plastic.

In the preferred embodiment, suction cups 6 and 8 are formed from clear high-temperature polyvinyl chloride, (PVC). This material is preferred because the clear color is unobtrusive and the PVC is pliable at a wide range of temperatures.

The opposite end of the coaxial cable 4, from the end that antenna wire 2 is coupled, is coupled to a radio frequency connector 10. In the preferred embodiment, a BNC connector is used because the antenna assembly is intended to be used with a scanning radio receiver that has the complementary BNC connector on its chassis. However, any radio frequency connector could be used, and, the type of connector used is not to be construed as a limitation of this invention.

The antenna assembly 1 is finished using heat-shrinkable tubing 12, 14, and 16 which has been shrunk onto the antenna assembly 1 at each end and over the connection of the antenna wire 2 and the coaxial cable 4. The heat-shrinkable tubing 12, 14, and 16 serves to strengthen the assembly, locate the suction cups, and protect the electrical conductors from short circuiting.

Reference is directed to FIG. 2 which is a sectional view of the antenna assembly 1, showing the details of assembly in the preferred embodiment. The end of antenna wire 2 is passed through the hole in the mounting boss 8A of suction cup 8. Antenna wire 2 is looped-back upon itself 22 and heat-shrinkable tubing 12 is placed over the looped-back section and extends a short distance over the antenna wire 2. Heat shrink tubing 12 is heated and shrunk to a snug fit on antenna wire 2. It is preferable for the combination of the diameter of antenna wire 2 plus the diameter of heat-shrinkable tubing 12 to combine to such a diameter that there exists a press-fit between heat-shrinkable tubing 12 and the inside diameter of the hole in mounting boss 8A.

Antenna wire 2 is connected to the center conductor at a first end of coaxial cable 4 at joint 20. In the preferred embodiment, this connection is made using a solder coupling. However, any electrical connection with reasonable mechanical strength would be acceptable. An alternative method of fabricating the antenna assembly is to remove the outer insulating jacket and outer conductor of coaxial cable 4 for such as length as to form antenna wire 2 from the center conductor and inner insulation layers of coaxial cable 4. In this form, there is no electrical connection 20 to be made in fabricating the assembly. This technique produces a uniform assembly with good electrical and mechanical properties. However, the extra effort required to accomplish the removal of the outer layers plus the cost differential between coaxial cable versus single conductor wire may offset the benefits.

A length of heat-shrinkable tubing 14 is positioned over the connection 20 and heated to shrink the heat-shrinkable tubing 14 in place.

A second end of coaxial cable 4 is passed through the hole in mounting boss 6A of suction cup 6. It is desirable for the outer diameter of coaxial cable 4 to fit snugly within the hole of mounting boss 6A. Further, to minimize the cost of the assembly through utilizing common parts, it is desirable for the outside diameter of heat-shrinkable tubing 12, when shrunk onto antenna wire 2, to equal the outside diameter of coaxial cable 4. By matching these two diameters suction cups 6 and 8 can have identical bosses 6A and 8A having identical diameter holes. Thereby, only one part is needed, which is used in twice the quantity. Further, heat-shrinkable tubing 20 will further retain the movement of suction cup 6 on coaxial cable 4.

The second end of coaxial cable 4 is connected to a radio frequency connector 10 utilizing whatever method is appropriate for the particular radio frequency connector. In the preferred embodiment, a BNC connector 10 is used which has a strain-relief ferrule 18 connected thereto. A length of heat-shrinkable tubing 16 is positioned over ferrule 18 and extends over the second end of antenna wire 4. The heat-shrinkable tubing 16 is heated and shrunk into place, thereby protecting and strengthening the connection.

In the preferred embodiment, the length of antenna wire 2 is approximately twenty-four inches and the length of coaxial cable 4 is approximately seven feet. The length of antenna wire 2 is selected to give good receiving characteristics while fitting most vehicle windshields. The length of coaxial cable 4 is selected to reach from the base of the windshield to the radio frequency connector on a dash-mounted receiver, including reasonable length for neatly routing the coaxial cable 4. It is to be understood that any reasonable length could be used to accomplish these purposes.

Reference is directed to FIG. 3 which is a view of a typical installation of the present invention in a vehicle. A section view 26 of the dashboard 30 and windshield 28 with a receiver 24 are shown, but are not a part of the present invention.

Antenna assembly 1 is installed by pressing suction cups 6 and 8 against the inside of windshield 28 such that antenna wire 2 is extended in a substantially linear fashion. Coaxial cable 4 is routed around the dashboard 30 and connected to receiver 24 using radio frequency connector 10.

Because of the foregoing, it is seen that antenna assembly 1 allows all unskilled user to install an antenna for a receiver quickly and simply without requiring the use of any tools.

While the foregoing specification and drawings enable those skilled in this and related arts to practice the present invention in accordance with the preferred embodiment, the claimed invention encompasses a broader scope. Further modifications and improvements may occur which will make obvious manifold variants of the present invention. The claims appended hereunto are intended to read upon all such variants.

What is claimed is:

1. A method of fabricating a low cost flexible wire antenna assembly, comprising the steps of:

electrically coupling a center conductor of a first end of a length of coaxial cable to a first end of a length of flexible wire at a connection point;

electrically coupling a radio frequency connector to a terminating end of said coaxial cable;

positioning a first suction cup, having a mounting boss with a hole formed therethrough, on said coaxial cable by passing said coaxial cable through said hole in said first suction cup, and locating said first suction cup along said coaxial cable near said connection point;

positioning a second suction cup, having a mounting boss with a hole formed therethrough, on said flexible wire, by passing said flexible wire through said hole in said second suction cup, and positioning said second suction cup near a free end of said flexible wire;

forming a looped back section in said free end of said flexible wire, and shrinking a first length of heat-shrinkable tubing onto said looped back section of said flexible wire, thereby restraining said looped back section of said free end and locating said second suction cup.

2. The method of claim 1, further comprising the steps of:

shrinking a second length of heat-shrinkable tubing onto said coaxial cable and said flexible wire, thereby covering said connection point and locating said first suction cup.

3. A method of fabricating a flexible wire antenna assembly, comprising the steps of:

removing a portion of an outer insulation layer and an outer conductor from a length of coaxial cable having a free end and a terminating end, thereby exposing a portion of an inner insulation layer having a center conductor therein, and thereby defining a feed line portion and a flexible wire portion, and further defining a connection point between said portions;

connecting a radio frequency connector to said terminating end of said coaxial cable;

positioning a first suction cup, having a mounting boss with a hole formed therethrough, on said coaxial cable by passing said coaxial cable through said hole in said first suction cup, and locating said first suction cup near said connection point;

positioning a second suction cup, having a mounting boss with a hole formed therethrough, on said flexible wire portion, by passing said flexible wire portion through said hole in said second suction cup, and positioning said second suction cup near said free end;

forming a looped back section in said free end of said flexible wire portion, and shrinking a first length of heat-shrinkable tubing onto said looped back section of said flexible wire portion, thereby restraining said looped back section of said free end and locating said second suction cup.

4. The method of claim 3, further comprising the steps of:

shrinking a second length of heat-shrinkable tubing onto said antenna assembly, thereby covering said connection point and locating said first suction cup.

5. A low cost flexible wire antenna suitable for easy mounting on an irregular smooth surface via suction mounting and holding a flexible wire antenna in a substantially linear position, comprising:

a flexible wire having a first end and a free end;

a feed line having a first end and a terminating end, said first end of said feed line being electrically coupled to said first end of said flexible wire at a connection point;

a first piece of heat shrinkable tubing disposed along said flexible wire at said free end and wherein said free end of said flexible wire is looped back upon itself and retained by said heat shrinkable tubing, and wherein the outside diameter of the combination of said flexible wire and said first piece of heat shrinkable tubing is substantially equal to the outside diameter of said feed line;

a substantially identical pair of suction cups each having a mounting boss formed thereon, said mounting boss having a hole formed therethrough, wherein a first of said pair of suction cups is disposed along said flexible wire near said free end and said first piece of heat shrinkable tubing and said flexible wire pass through said hole in said mounting boss, and wherein a second of said pair of suction cups is disposed along said feed line near said connection point and said feed line passes through said hole in said mounting boss, and a radio frequency connector attached and electrically coupled to said terminating end of said fee line.

6. The antenna of claim 5, and wherein said feed line is a coaxial cable having a center conductor and said flexible wire is electrically coupled to said center conductor at said connection point.

7. The antenna of claim 6, and wherein said first of said pair of suction cups is retained along said flexible wire near said free end by a press fit, and said second of said pair of suction cups is retained along said feed line near said connection point by a press fit.

8. The antenna of claim 7, further comprising:

a second piece of heat shrinkable tubing disposed along said feed line and said flexible wire, and wherein said second piece of heat shrinkable tubing covers said connection point.

9. The antenna of claim 7, wherein said flexible wire is formed from said center conductor of said coaxial cable and said electrically coupled connection point is a result of the continuation of said center conductor beyond said coaxial cable feed line.

* * * * *